US006776027B2

(12) United States Patent
Zentani et al.

(10) Patent No.: US 6,776,027 B2
(45) Date of Patent: Aug. 17, 2004

(54) CIGARETTE INSPECTION DEVICE

(75) Inventors: Kenichi Zentani, Tokyo (JP); Fumio Kubo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/344,763

(22) PCT Filed: Aug. 9, 2001

(86) PCT No.: PCT/JP01/06841

§ 371 (c)(1),
(2), (4) Date: Feb. 14, 2003

(87) PCT Pub. No.: WO02/13637

PCT Pub. Date: Feb. 21, 2002

(65) Prior Publication Data

US 2003/0172719 A1 Sep. 18, 2003

(30) Foreign Application Priority Data

Aug. 17, 2000 (JP) ..... 2000-247572
Aug. 17, 2000 (JP) ..... 2000-247573
Aug. 17, 2000 (JP) ..... 2000-247574

(51) Int. Cl.[7] ..... G01N 15/08
(52) U.S. Cl. ..... 73/38
(58) Field of Search ..... 73/38

(56) References Cited

U.S. PATENT DOCUMENTS 4,325,250 A 4/1982 Bolt et al. ..... 73/38
4,406,156 A * 9/1983 Pezzi ..... 73/38
4,584,870 A * 4/1986 Doerman ..... 73/40
4,662,214 A * 5/1987 Heitmann et al. ..... 73/38
4,888,977 A 12/1989 Chehab et al. ..... 73/38
5,186,183 A * 2/1993 Komori et al. ..... 131/281

FOREIGN PATENT DOCUMENTS

| | | |
|---|---|---|
| EP | 584773 A1 | 3/1994 |
| JP | 10-49663 A | 2/1998 |
| JP | 11-86180 A | 3/1999 |
| JP | 11-287704 A | 10/1999 |
| JP | 2000-146820 A | 5/2000 |

* cited by examiner

*Primary Examiner*—Daniel S. Larkin
(74) *Attorney, Agent, or Firm*—Birch, Stewart, Kolasch & Birch, LLP

(57) ABSTRACT

A cigarette inspection apparatus is provided, which is capable of measuring ventilation resistances of a large number of filter cigarettes easily and accurately and which includes an inspection drum (12) provided with part of an air-introducing unit for introducing air into a filter cigarette (C) from a non-filter side end face thereof, a measurement section (13) provided with the rest of the air-introducing unit, pressure transducers (17, 18) for detecting inlet side and outlet side air pressures of the cigarette, and a data processor (31) for determining the ventilation resistance of the cigarette based on a difference between the air pressures.

4 Claims, 8 Drawing Sheets

CIGARETTE INSPECTION DEVICE

This application is the national phase under 35 U.S.C. §371 of PCT International Application No. PCT/JP01/06841 which has an International filing date of Aug. 9, 2001, which designated the United States of America.

TECHNICAL FIELD

The present invention relates to a cigarette inspection apparatus for detecting a quality defect in a filter cigarette.

BACKGROUND ART

The quality, especially the flavor and taste, of a cigarette is affected by a variety of factors, one of which is ventilation resistance of the cigarette. In the process of manufacturing cigarettes, therefore, in general, a predetermined number of cigarettes per lot are sampled, and the ventilation resistances of the sampled cigarettes are measured one by one by using, for example, a cigarette inspection apparatus (ventilation measuring apparatus) shown in FIG. 11. The measured values of the ventilation resistances are used for quality control of cigarettes.

The ventilation measuring apparatus shown in FIG. 11 comprises a container 1 having supporters 3*a*, 3*b* and 3*c* for supporting a cigarette C to be measured. Each supporter has a support ring and a support member made of a flexible material and disposed on the inner peripheral surface of the support ring. When negative pressure is applied to a suction chamber formed in the support ring, a cylindrical portion of the support member is pulled toward the support ring, so that a central hole is enlarged which is provided in a bulkhead of the support member formed integrally with the cylindrical portion. In this state, if a cigarette C is supplied into the container 1 from the upper end opening of the container 1, the cigarette C freely falls while being guided by guides 5 and 6, and passes through the central holes of the support members disposed in the supporters 3*c*, 3*b* and 3*a* sequentially, until the tip of the cigarette C is brought into contact with a stopper 7 located right under the supporter 3*a*.

Next, the suction chamber is communicated with the atmosphere, so that diameters of the central holes of the support members are restored to their former sizes. This permits the three support members to airtightly hold the tip of a filter section F, boundary between the filter section F and a tobacco wrapping section T, and tip of the tobacco wrapping section T of the cigarette C, respectively. In the container 1, three airtight chambers 2*a*, 2*b*, and 2*c* are defined by the supporters 3*a*, 3*b*, and 3*c*, a shutter 4, and the cigarette C. Although not shown in the figure, the first airtight chamber 2*a* is connected to a decompressor through a flowmeter, whereas the first and second airtight chambers 2*b* and 2*c* are communicated with the atmosphere through flowmeters.

When the air in the first airtight chamber 2*a* is sucked out by the decompressor, the air in the second and third airtight chambers 2*b* and 2*c* flows into the cigarette C through the peripheral surfaces of the filter section F and the tobacco wrapping section T, flows through the cigarette C, and flows into the first airtight chamber 2*a* from the tip face of the filter section F. A flow rate Vc of the air discharged by suction from the first airtight chamber 2*a* and flow rates Vf and Vp of the air flowing into the cigarette C through the peripheral surfaces of the filter section F and the tobacco wrapping section T in the second and third airtight chambers 2*b* and 2*c* are measured by means of three respective flowmeters, and the ventilation resistances are determined based on the measured values Vc, Vf, and Vp. After the measurement, the stopper 7 retreats to a retreat position as shown in the figure, and the shutter 4 is opened. As a result, the cigarette C freely falls to be discharged from the container 1. Then, the stopper 7 is moved forward to a cigarette-holding position, and the shutter 4 is closed to prepare for the subsequent measurement.

The above-mentioned ventilation measuring apparatus is constructed with the intention of measuring the ventilation resistances of the cigarettes one by one, which cigarette are sampled in the cigarette manufacturing process and thus limited in number. For this reason, it is extremely difficult to measure the ventilation resistances by means of the ventilation measuring apparatus with respect to all the cigarettes that are manufactured in large quantities through the cigarette manufacturing process.

That is, the ventilation resistance measurement using a ventilation container includes, as mentioned before, the first step of introducing the cigarette into the container 1, the second step of discharging the air in the first airtight chamber by suction while measuring the flow rate of the air discharged from the first airtight chamber and the flow rates of the air flowing into the second and third airtight chambers, and the third step of ejecting the cigarette from the container 1. Thus, it takes time to run the measurement. In actuality, therefore, it is impossible to carry out such ventilation resistance measurement with respect to all the cigarettes, especially on-line in succession. Furthermore, the on-line measurement requires a cigarette carrier system for carrying cigarettes from the cigarette manufacturing process to the ventilation measuring apparatus, and a cigarette inspection apparatus including such a carrier system has a large-scale structure.

By the way, a notable wrapping defect can occur in the cigarette, which may bring about a great air leakage. In case of such a cigarette, a large amount of air flows out of the cigarette or flows thereinto through the wrapping-defective part during the measurement of the ventilation resistance, resulting in such a notable error in the measured value as to stultify the ventilation measurement itself. The ventilation resistance measurement using the ventilation measuring apparatus has a drawback that it requires a long time for measurement with respect to a cigarette having a notable wrapping defect.

DISCLOSURE OF THE INVENTION

An object of the present invention is to provide a cigarette inspection apparatus capable of easily detecting a notable quality defect in a cigarette.

Another object of the present invention is to provide a cigarette inspection apparatus capable of measuring ventilation resistance of a cigarette easily and accurately.

Further another object of the present invention is to provide a cigarette inspection apparatus capable of measuring ventilation resistances with respect to all cigarettes manufactured in a cigarette manufacturing process.

In order to achieve the above objects, a cigarette inspection apparatus according to the present invention comprises air-introducing means for introducing air into a filter cigarette from a first end of the filter cigarette, which is on a non-filter side of the cigarette, a first pressure transducer for detecting an air pressure on a side close to the first end of the filter cigarette, and quality-judging means for judging quality of the filter cigarette, based on the air pressure detected by the first pressure transducer.

The cigarette inspection apparatus of the present invention has been invented with a recognition that a pressure drop in a filter cigarette at the time of introducing air into the cigarette through the first end of the non-filter side thereof indicates an amount of air leakage corresponding to a cigarette quality, especially a wrapping defect in the cigarette. Therefore, the cigarette inspection apparatus is capable of judging easily the cigarette quality, more particularly a quality defect in the cigarette, based on the air pressure on the first end side of the filter cigarette. In other words, the pressure drop in the filter cigarette can be determined based on the air pressure on the first end side before the air introduction into the cigarette and the air pressure on the first end side at the time of the air introduction. Based on this pressure drop, the cigarette quality, especially a notable quality defect in the cigarette can be easily judged. It is preferable that the air pressure is detected in a state where a peripheral surface of the filter cigarette is open to the atmosphere. The air introduction into the cigarette and the detection of the air pressure can be realized with a simple structure, and it is relatively easy to incorporate an apparatus having such a structure into a cigarette manufacturing apparatus. Therefore, the cigarette inspection apparatus according to the present invention is suitable to perform a 100% inspection of the quality associated with the ventilation resistances of the cigarettes manufactured in the cigarette manufacturing process.

Preferably, the cigarette inspection apparatus according to the present invention further comprises a second pressure transducer for detecting an air pressure produced on a side close to a second end of a filter cigarette, which is a filter side of the cigarette, due to the air introduced into the cigarette, and the quality-judging means has measuring means for determining the ventilation resistance of the filter cigarette, based on a difference between the air pressures detected by the first and second pressure transducers, respectively, and judges the quality of the filter cigarette based on the ventilation resistance.

The cigarette inspection apparatus according to this preferred embodiment is designed to judge the cigarette quality, based on an air pressure difference between both the ends of a filter cigarette, which accurately represents the pressure drop in the cigarette caused with the air introduction into the cigarette, and is hence excellent in accuracy of the cigarette quality judgement. It is preferable that the air pressure detection is performed in a state where the peripheral surface of the filter cigarette is open. The cigarette inspection apparatus is simple in structures for introducing air into the cigarette and for detecting the difference in the air pressure, and is hence suitable for incorporation into the cigarette manufacturing apparatus and for the 100% inspection of cigarettes.

Preferably, the air-introducing means comprises a first passage member having an air passage with an air outlet for discharging air supplied from an air source, the first passage member being disposed for abutment with a first end face of a filter cigarette, which is on the non-filter side of the cigarette, and pressure means for pressing a second end face of the filter cigarette, which is on the filter side of the cigarette, in an axial direction to make the first end face of the filter cigarette connected to the air outlet of the first passage member. The first pressure transducer is connected to the air passage of the first passage member.

According to this preferred embodiment, it is possible to surely introduce air to the non-filter side end face of a filter cigarette from the air outlet of the first passage member connected to the non-filter side end face of the cigarette, improving accuracy of the air pressure detection using the first pressure transducer. Thus, the cigarette quality can be judged with high accuracy.

More preferably, the pressure means includes a metal mouthpiece having an end face, which is formed into a flat face, for pressing the second end face of a filter cigarette and supported displaceably in an axial direction.

According to this preferred embodiment, it is possible to surely introduce air through the air outlet passage of the first passage member to the non-filter side end face of a filter cigarette while holding the filter cigarette between the first passage member and the mouthpiece, which improves the accuracy of the cigarette quality judgement. Moreover, a structure for holding the cigarette between the first passage member and the mouthpiece by axially displacing the mouthpiece is simple, making this cigarette inspection apparatus suitable for incorporation into the cigarette manufacturing apparatus. Furthermore, since a cigarette is pressed by the flat end face of the mouthpiece, there is only a little fear of damaging the cigarette.

Preferably, the cigarette inspection apparatus further comprises an inspection drum having a rotary shaft and a peripheral surface thereof formed, at intervals in a circumferential direction, with a plurality of cigarette holders for receiving the filter cigarettes dischargeably, and a first stationary member supported for sliding contact with the first passage member. The first passage member is formed of a ring member that is mounted on a peripheral edge portion of one side of the inspection drum so as to be rotatable in unison with the inspection drum. A plurality of air passages are formed in the first passage member at intervals in the circumferential direction so as to be alignable to the cigarette holders of the inspection drum in the axial direction. The first stationary member is formed with an air passage with which the plurality of air passages of the first passage member can communicate sequentially, and the first pressure transducer is connected to the air passage of the first stationary member.

According to this preferred embodiment, with rotation of the inspection drum and the first passage member mounted thereon, the air passages of the first passage member sequentially communicate with the air passage of the first stationary member. As a result, air can be introduced sequentially into the filter cigarettes received in the respective cigarette holders of the inspection drum through the air passage of the first stationary member and the corresponding air passage of the first passage member. At this moment, the individual cigarette is pressed toward the first passage member by the pressure means, and air is introduced into the cigarette without fail. Also, the air pressure on the first end face side, i.e., the non-filter side, of the cigarette is detected by the first pressure transducer. It is preferable that the air pressure is detected in the state where the peripheral surface of a cigarette is open to the atmosphere.

In the preferred cigarette inspection apparatus, the quality of the filter cigarettes received in the respective cigarette holders of the inspection drum is sequentially judged with the inspection drum rotated. The filter cigarette that has been judged in its quality is discharged from the cigarette holder, which enables a new filter cigarette to be received in the cigarette holder. Thus, the quality judgement can be performed efficiently with respect to a large number of filter cigarettes. Furthermore, the inspection drum can be utilized as a conveyance drum of the cigarette manufacturing apparatus, which facilitates incorporation of the cigarette inspection apparatus into the cigarette manufacturing apparatus. If necessary, the filter cigarettes manufactured by the cigarette manufacturing apparatus can be subjected to the 100% inspection.

According to the present invention, preferably, the air-introducing means comprises a first passage member having an air passage with an air outlet for discharging air supplied from an air source and disposed for abutment with a first end face of a filter cigarette, which is on the non-filter side of the cigarette, and pressure means for pressing the filter cigarette in the axial direction to make the first end face of the non-filter side thereof connected to the air outlet of the first passage member. The pressure means has a mouthpiece which can press a second end face of a filter cigarette, which is on the filter side of the cigarette, the mouthpiece being formed with an air passage having on one side thereof an opening end connectable to the second end face of the cigarette, and a second passage member for supporting the mouthpiece displaceably in the axial direction, the second passage member being formed with an air passage communicating with an opening end on another side of the air passage of the mouthpiece. The first and second pressure transducers are connected to the air passage of the first passage member and the air passage of the second passage member, respectively.

According to this preferred embodiment, it is possible to introduce air into a filter cigarette without fail and to surely detect the air pressures on the first and second end face sides of the cigarette, respectively, in a state where the filter cigarette is held between the first passage member and the mouthpiece.

More preferably, the cigarette inspection apparatus further comprises an inspection drum having a rotary shaft and a peripheral surface thereof formed, at intervals in the circumferential direction, with cigarette holders for receiving filter cigarettes dischargeably, and first and second stationary members supported for sliding contact with the first and second passage members, respectively. The first and second passage members are formed of ring members that are mounted on peripheral edge portions of both sides of the inspection drum, respectively, so as to be rotatable in unison with the inspection drum. Air passages are formed in the first passage member at intervals in the circumferential direction so as to be alignable to the cigarette holders of the inspection drum in the axial direction. The second passage member supports a plurality of mouthpieces displaceably in the axial direction, the mouthpieces being formed with air passages that are alignable to the cigarette holders of the inspection drum in the axial direction, respectively. The second passage member is formed with a plurality of air passages communicating with the respective air passages of the mouthpieces. The first stationary member is formed with an air passage with which the air passages of the first passage member can communicate sequentially, whereas the second stationary member is formed with an air passage with which the air passages of the second passage member can communicate sequentially. The first and second pressure transducers are connected to the air passage of the first stationary member and that of the second stationary member, respectively.

According to this preferred embodiment, with rotation of the inspection drum and the first and second passage members mounted thereon, the air passages of the first passage member sequentially communicate with the air passage of the first stationary member, and the air passages of the mouthpieces communicate with the air passage of the second stationary member one after another through the respective air passages of the second passage member. Accordingly, air can be sequentially introduced into the filter cigarettes received in the respective cigarette holders of the inspection drum through the air passage of the first stationary member and the corresponding air passage of the first passage member. Also, the air pressures on the first and second end face sides of the cigarette can be individually detected without fail. Thus, judgement on the quality of a large number of cigarettes can be efficiently performed. Moreover, the use of the inspection drum as a conveyance drum of the cigarette manufacturing apparatus facilitates the incorporation of the cigarette inspection apparatus into the cigarette manufacturing apparatus. It is also possible to subject the filter cigarettes manufactured by the cigarette manufacturing apparatus to the 100% inspection.

Preferably, the cigarette inspection apparatus detects the air pressure produced on the first end face of the non-filter side of a filter cigarette by the first pressure transducer in a state where the peripheral surface of the cigarette is open to the atmosphere and the air introduced into the cigarette is prohibited from flowing out from the second end face of the filter side of the cigarette.

According to this preferred embodiment, the pressure drop in the cigarette can be detected with high precision, based on the air pressures detected before and at the time of introducing air, respectively, and the cigarette quality can be accurately judged.

Preferably, the cigarette inspection apparatus detects the air pressures produced on the first end face of the non-filter side of a filter cigarette and on the second end face of the filter side thereof by the first and second pressure transducers, respectively, in the state where the peripheral surface of the cigarette is open to the atmosphere and the air introduced into the cigarette is prohibited from flowing out from the second end face of the filter side of the cigarette.

According to this preferred embodiment, the pressure drop in the cigarette can be detected with high precision, based on the difference between the air pressures produced on both end faces of the cigarette, respectively, and the cigarette quality can be accurately judged.

In case of the cigarette inspection apparatus designed to permit the air passages of the second passage member, communicating with the respective air passages of the mouthpieces, to communicate sequentially with the air passage of the second stationary member, it is preferable that the air passage of the second stationary member has an opening only on the second passage member side of the second stationary member.

According to this preferred embodiment, in a state where the mouthpiece is in contact with the second end face of a cigarette, air passages, corresponding to the cigarette, of the mouthpiece, the second passage member and the second stationary member define a closed space as a whole, thus preventing air from flowing out from the second end face of the cigarette.

Preferably, the quality-judging means subjects output of the first pressure transducer to filtering to remove a noise component, and determines, at a predetermined measurement timing, the air pressure on the first end side of the filter cigarette, based on the filtered output.

According to this preferred embodiment, it is possible to remove an external noise superposed on the output of the first pressure transducer, such as for example, a noise component, especially a high frequency noise component, mingled during the cigarette manufacturing process. Therefore, the air pressure can be detected with precision.

In the cigarette inspection apparatus comprising the first and second pressure transducers, it is preferable that the measuring means subjects outputs of the first and second pressure transducers to filtering to remove noise components, determines a difference between the two filtered outputs at a predetermined measurement timing, and determines the ventilation resistance of a filter cigarette, based on the difference between the filtered outputs.

According to this preferred embodiment, it is possible to remove external noises superposed on the outputs of the first and second pressure transducers and to obtain the ventilation resistance of the cigarette with great accuracy, based on the difference between the two outputs.

The cigarette inspection apparatus comprising the first and second pressure transducers preferably further comprises an inspection drum having a peripheral surface thereof formed with cigarette holders for holding filter cigarettes. The air-introducing means sequentially introduces air into filter cigarettes that are carried one by one to an inspection position according to rotation of the inspection drum. The first and second pressure transducers sequentially detect the air pressures on the first and second end sides of the filter cigarettes into each of which air is introduced when the individual cigarette is at the inspection position. The measuring means sequentially determines the ventilation resistances of the filter cigarettes into each of which air is introduced when the individual cigarette is at the inspection position. The quality-judging means comprises measured data-classifying means for classifying the ventilation resistances of filter cigarettes, which have sequentially been determined by the measuring means, so that the ventilation resistances of each cigarette correspond to the cigarette holder with which that cigarette has been held, and evaluating means for evaluating a cigarette-holding characteristic of each cigarette holder, based on a characteristic indicated by a set of the ventilation resistances corresponding to that cigarette holder.

According to this preferred embodiment, it is possible to precisely grasp an effect of each cigarette holder upon the ventilation resistances of filter cigarettes, more particularly a cigarette-holding characteristic of each cigarette holder, based on the characteristic indicated by the set of the ventilation resistances classified to correspond to that cigarette holder. In the present invention, it is desired to detect the air pressure produced on the end faces of a filter cigarette due to the air introduction into the filter cigarette in the state where the peripheral surface of the cigarette is open to the atmosphere, and the introduced air is prohibited from flowing out from the filter side end face of the cigarette. It is also desired that air should be properly introduced from the non-filter side end face of the cigarette. The cigarette-holding characteristic of each cigarette holder of the inspection drum is closely associated with such conditions. If the cigarette-holding characteristic of any one of the cigarette holders is declined, the accuracy of the cigarette quality judgement on the basis of the air pressure is deteriorated, which produces fear of inducing a misjudgment. In this point, the cigarette inspection apparatus according to the preferred embodiment is designed to grasp the cigarette-holding characteristic of each cigarette holder with accuracy. This makes it possible to detect immediately the cigarette holder whose cigarette-holding characteristic is deteriorated to suggest maintenance thereof and to reject a result of the cigarette quality judgement in respect of such cigarette holder to avert the misjudgment.

More preferably, the evaluating means determines dispersion or a mean value of the ventilation resistances corresponding to the individual cigarette holder, as the characteristic indicated by the set of the ventilation resistances.

According to this preferred embodiment, it is possible to obtain accurately the characteristic indicated by the set of the ventilation resistances corresponding to the individual cigarette holder.

Preferably, the evaluating means provides a graphical representation of the characteristics, indicated by those sets of the ventilation resistances which correspond to the cigarette holders, in which representation the characteristics are arranged in an order the cigarette holders are guided to the inspection position according to the rotation of the inspection drum.

With this preferred embodiment, the characteristics indicated by the sets of the ventilation resistances corresponding to the respective cigarette holders can be easily compared with one another, based on the graphical representation.

Preferably, the evaluating means comprises malfunction-detecting means for detecting the cigarette holder whose cigarette-holding characteristic is deteriorated, based on the characteristics indicated by the sets of the ventilation resistances corresponding to the respective cigarette holders.

According to this preferred embodiment, the cigarette holder whose cigarette-holding characteristic is deteriorated can be accurately detected to suggest the maintenance thereof, thus averting a misjudgment on the cigarette quality.

BEST MODE OF CARRYING OUT THE INVENTION

A cigarette inspection apparatus according to an embodiment of the present invention will be explained below with reference to drawings.

The cigarette inspection apparatus of the embodiment is mounted on a cigarette manufacturing apparatus and designed to perform a 100% inspection of ventilation characteristics of filter cigarettes that are manufactured by the cigarette manufacturing apparatus.

Figure 1:
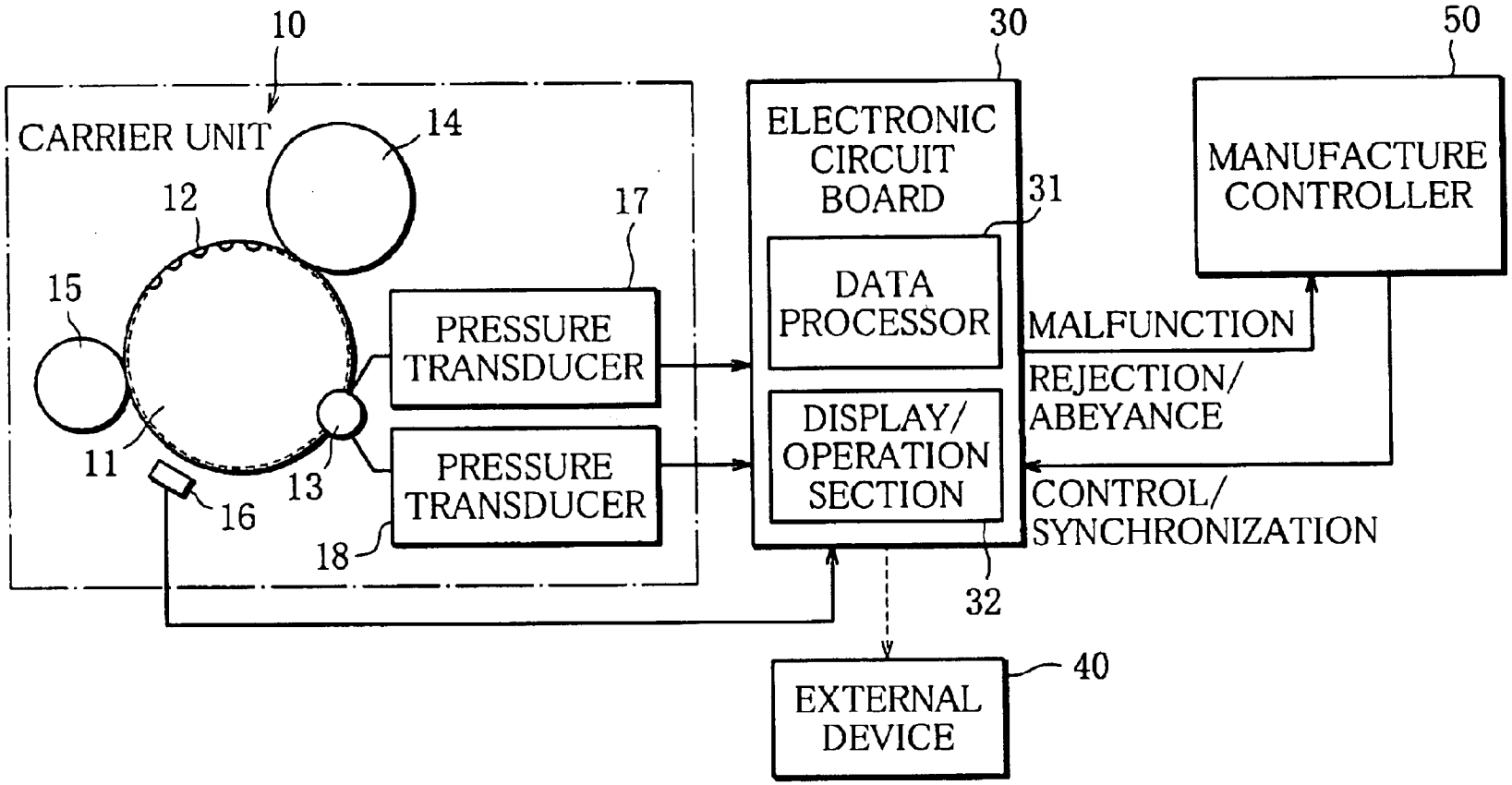
FIG. 1 is a schematic view of a cigarette inspection apparatus according to an embodiment of the present invention.

The cigarette inspection apparatus has a carrier unit shown by reference numeral 10 in FIG. 1, and a part of the carrier unit 10 consists of a drum train located between a filter attachment unit and wrapping unit of the cigarette manufacturing apparatus. The drum train includes a conveyance drum 11, an end checker drum 14 disposed in contact with an upper peripheral surface of the drum 11, and a carrier drum 15 disposed in contact with a lower peripheral surface of the conveyance drum 11. The drums 11, 14, and 15 hold or release cigarettes in accordance with application or stoppage of application of negative pressures to cigarette-receiving grooves formed on peripheral surfaces of the drums, whereby the cigarettes are delivered between the drums.

Specifically, the end checker drum 14 receives the filter cigarettes manufactured consecutively by the cigarette manufacturing apparatus, inspects directions of filter ends, and supplies the filter cigarettes one by one to the conveyance drum 11. The conveyance drum has a peripheral surface thereof formed, at regular intervals in a circumferential direction, with a plurality of (for example, forty) cigarette-receiving grooves, namely cigarette holders 12. The conveyance drum 11 sucks the filter cigarettes one by one by using negative pressure and holds the cigarettes in the respective cigarette holders 12, which cigarettes are sequentially supplied from the end checker drum 14. The conveyance drum 11 rotates around a rotary shaft 11*a* thereof, transfers the filter cigarettes in the circumferential direction for ventilation resistance measurement in a measurement section 13 that is fixed adjacent to the peripheral surface of the conveyance drum 11, and delivers the cigarettes to the carrier drum 15. In FIG. 1, reference numeral 16 represents a position sensor for detecting a rotation reference position of the conveyance drum 11.

As is understood from the above explanation, the conveyance drum 11 constitutes a part of the drum train that transports filter cigarettes from the filter attachment unit to the wrapping unit, and serves as an inspection drum for carrying the filter cigarettes to the measurement section 13 of the cigarette inspection apparatus.

The cigarette inspection apparatus comprises an air-introducing unit for supporting the filter cigarette from both ends thereof, which cigarette is held in the cigarette holder 12 of the conveyance drum 11, and for introducing air into the cigarette through a non-filter side end (to be exact, a tip face of the non-filter side) thereof.

Figure 2:
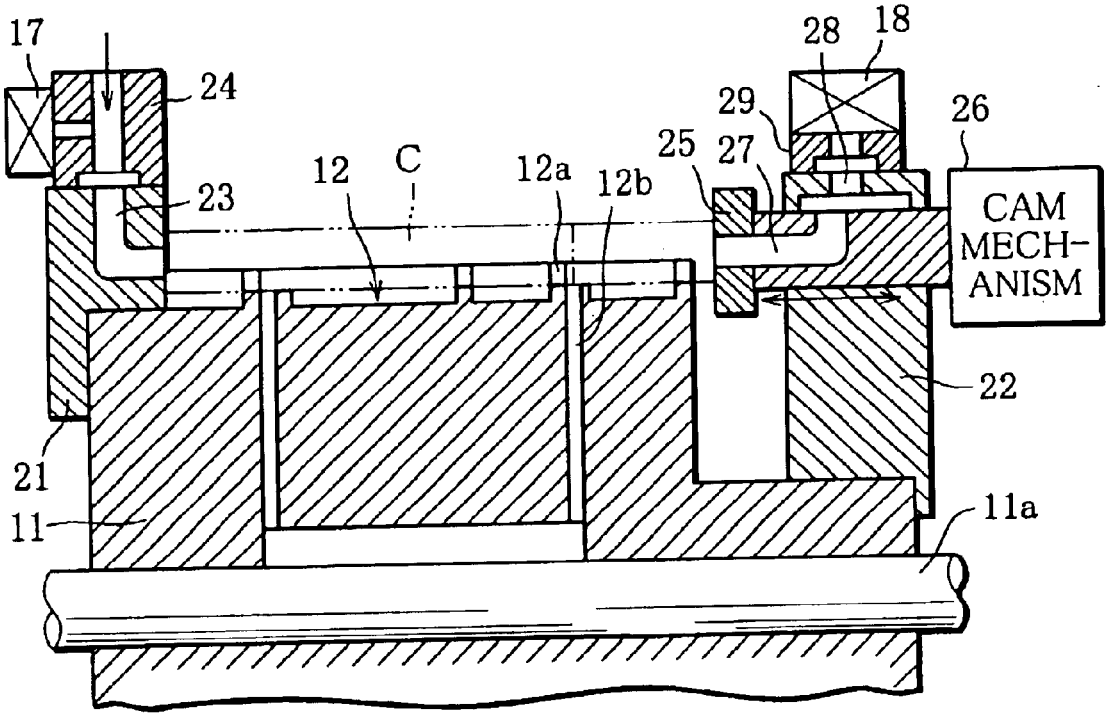
FIG. 2 is a view showing an example of a construction of a conveyance drum and measurement section of the cigarette inspection apparatus shown in FIG. 1.

As shown in FIG. 2, the air-introducing unit comprises a first and second testing rings (passage members) 21 and 22 mounted on the conveyance drum 11 so as to be rotatable in unison therewith, and a first and second funnels (stationary members) 24 and 29 provided in the measurement section 13, which funnels are supported immovably.

The first testing ring 21 is mounted on a peripheral edge portion of the conveyance drum 11, which portion is on one end face side of the drum, so that an outer peripheral surface of the ring is disposed in sliding contact with a bottom surface of the first funnel 24. The testing ring 21 is formed with air-introducing holes 23 which are the same in number as the cigarette holders 12 provided on the peripheral surface of the conveyance drum 11. Each of the air-introducing holes 23 has both ends thereof opening to the outer peripheral surface and an inner end face of the first testing ring 21, respectively. The inner opening (air outlet) is aligned with the corresponding cigarette holder 12 and adapted to face the tip face of the non-filter side of a filter cigarette C held in that cigarette holder 12. The air-introducing holes 23 formed in the first testing ring 21 sequentially communicate with an air-introducing passage of the first funnel 24 with rotation of the conveyance drum 11. When one of the air-introducing holes 23 of the first testing ring 21 communicates with the air-introducing passage of the funnel 24, pressurized air is supplied from an air source (not shown) connected to the funnel 24 to the cigarette C in the cigarette holder 12 corresponding to the air-introducing hole 23.

The air source can comprise, for instance, a compressor for producing high pressure air having a pressure of approximately $4.9\times10^5$ Pa (=5 kgf/cm$^2$) and a regulator for decreasing the pressure of the high pressure air supplied from the compressor to a pressure of approximately $9.8\times10^3$ Pa (=0.1 kgf/cm$^2$).

The cigarette inspection apparatus comprises a first pressure transducer 17 communicating with the air-introducing passage of the first funnel 24 directly or via a cheese, not shown. The pressure transducer 17 detects pressure of the air introduced to the filter cigarette C (inlet side air pressure) P1.

The second testing ring 22 is fixed on the peripheral edge portion of the other side of the conveyance drum 11 and has the outer peripheral surface thereof disposed in sliding contact with a bottom surface of the second funnel 29. The testing ring 22 is formed with mouthpiece insertion through holes, which are the same in number as the cigarette holders 12 of a conveyance ring 11, such that they are aligned with the cigarette holders 12 in an axial direction. Mouthpieces 25 are disposed in the respective insertion through holes for advance and retreat axial movements. The mouthpiece 25 has an inner end of a diameter size large enough to prevent the mouthpiece from being disengaged from the insertion through hole. With the rotation of the conveyance drum 11, outer ends of the mouthpieces 25 that are in abutment with a cam mechanism 26 provided in the measurement section 13 are axially displaced (refer to FIG. 10) by the cam mechanism 26 with a predetermined pressure toward the first testing ring 21 against a spring force of a spring, not shown, for urging the mouthpieces 25 toward the cam mechanism 26. In other words, the mouthpiece 25 serves as pressure means for pressing the tip face of the filter side of the filtered cigarette C to bring the tip face of the non-filter side of the cigarette C into abutment with an inner end face of the first funnel 21. As a result, the cigarette C is held between the first testing ring 21 and the mouthpiece 25, and the non-filter side end face of the cigarette C is connected to the air-introducing hole 23 of the first funnel 21. Meanwhile, a moving distance of the mouthpiece 25 and a pressing force thereof may be appropriately determined in accordance with a specification of the cigarette C to be measured.

The mouthpiece 25 is made of metal and has an inner end face thereof formed into a flat face. The mouthpiece 25 is formed with a through hole 27 having two ends thereof opening to the inner end face and peripheral surface of the mouthpiece 25, respectively. The inner opening of the through hole 27 is aligned with the cigarette holder 12 of the conveyance drum 11 and adapted to face the filter side end face of the filter cigarette C in the cigarette holder 12. With rotation of the conveyance drum 11, the through holes 27 formed in the mouthpieces 25 sequentially communicate with the air passage of the second funnel 29 provided in the measurement section 13 through a communication hole 28 provided in the second testing ring 22.

The cigarette inspection apparatus comprises a second pressure transducer 18 communicating with the air passage of the second funnel 29 and adapted to measure the pressure (outlet side air pressure) P2 generated on the filter side end face of the filter cigarette C at the time of introducing air to the cigarette C. It is noteworthy that the outlet of the air passage of the second funnel 29 communicating with the through hole 27 of the mouthpiece 25 is closed by means of the second pressure transducer 18, and accordingly the measurement of the air pressure P2 by using the second pressure transducer 18 is performed in a state where the air introduced into the filter cigarette C is prohibited from flowing out from the filter end.

As shown in cross section in FIG. 2, the cigarette holder 12 comprises a plurality of projections 12*a* each formed into a half ring and is adapted to be brought into light contact with the peripheral surface of the filter cigarette C at a plurality of positions in a longitudinal direction of the cigarette C to thereby hold the cigarette C. Specifically, the cigarette holder 12 composed of such projections 12*a* has its bottom to which suction holes 12*b* formed in the conveyance drum 11 are opened. Using the negative pressure supplied through the suction holes 12*b*, the cigarette holder 12 lightly sucks the filter cigarette C placed on the projections 12*a*, to thereby hold the cigarette C in a state where the peripheral surface of the cigarette C is substantially open.

The cigarette inspection apparatus comprises an electronic circuit board shown by reference numeral 30 in FIG. 1. The electronic circuit board 30 includes a data processor 31 and a display/operation section 32 formed of a touch panel or the like. The data processor 31 has a function of inputting output signals of the first and second pressure transducers 17 and 18, which signals respectively indicate the inlet side and outlet side air pressures P1 and P2 at the time of introducing air into the cigarette C positioned in the measurement section 13, and a function of determining the ventilation resistance of the cigarette C based on the both output signals.

Moreover, the data processor 31 has a function of aggregating the ventilation resistances which have been obtained with respect to cigarettes on an individual basis in cooperation with an external device 40, such as a personal computer or the like, and a function of evaluating a cigarette-holding characteristic of each cigarette holder 12. Further, the data processor 31 has a function of, for example, giving a command, to a manufacture controller 50, of abeyance of cigarette manufacture and the like and a command of rejecting the filter cigarette evaluated to be defective in quality, in accordance with a result of evaluation.

Figure 3:
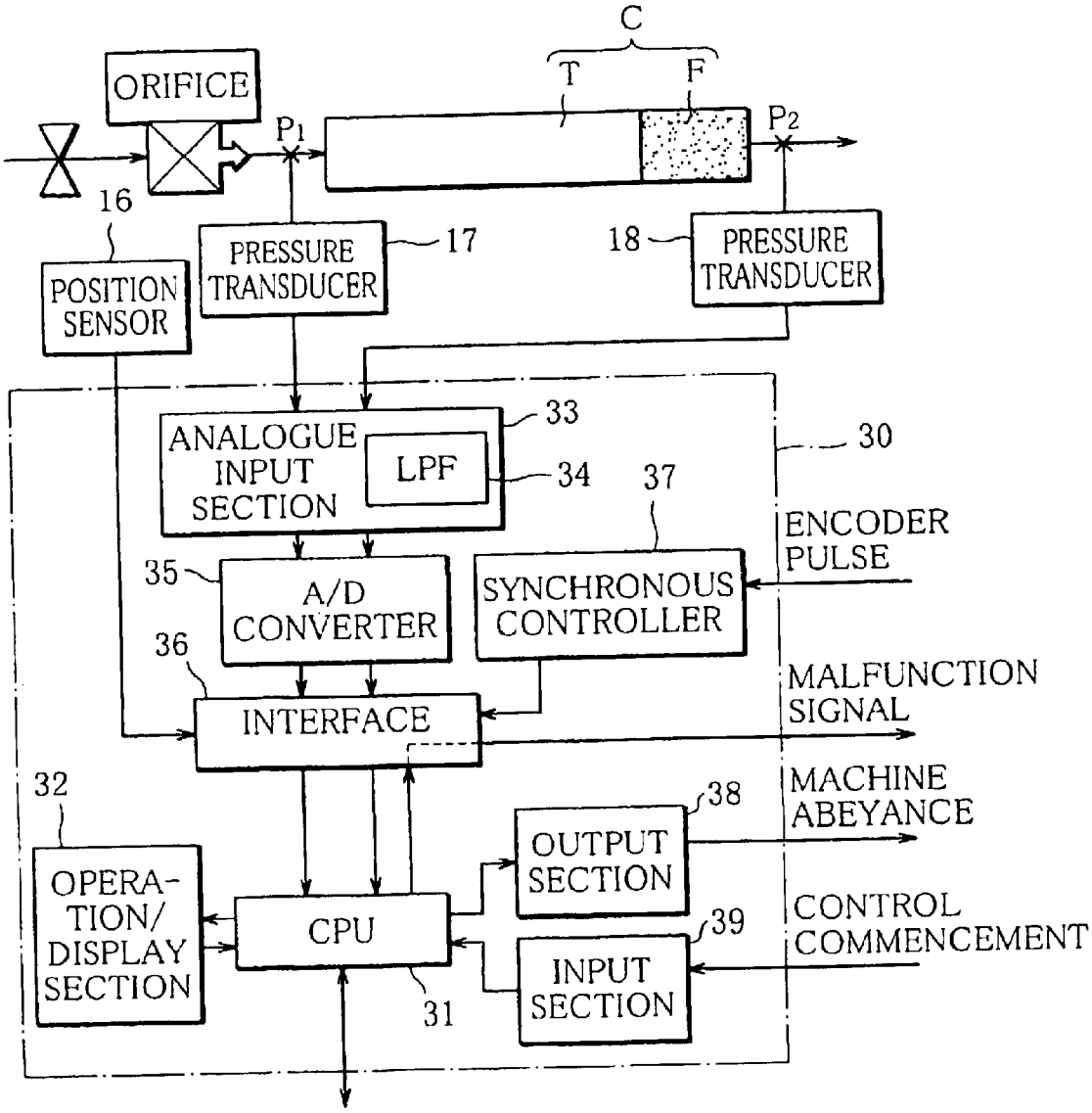
FIG. 3 is a view showing an example of a construction of an electronic circuit board of the cigarette inspection apparatus shown in FIG. 1.

Specifically, the electronic circuit board 30 is constructed as shown by way of example in FIG. 3. An analogue input section 33 provided in the electronic circuit board 30 forms an interface for the first and second pressure transducers 17 and 18 and comprises a low-pass filter (LPF) 34 for filtering outputs of the pressure transducers 17 and 18.

Figure 4:
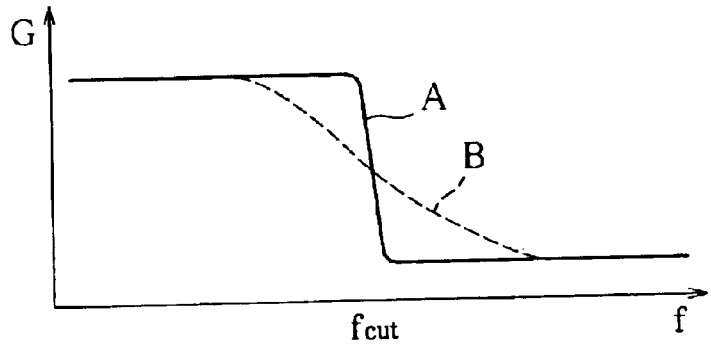
FIG. 4 is a view showing characteristics of a low-pass filter incorporated into the electronic circuit board shown in FIG. 3.

As shown by way of example in FIG. 4, the low-pass filter 34 has a high-order filter characteristic A that achieves sharp filtering of the outputs of the pressure transducers 17 and 18 at a predetermined cut-off frequency $f_{cut}$ and serves to sharply cut off only an external noise containing a high-frequency component and getting mixed into a detection system (analogue signal system) to be superimposed on output voltages of the pressure transducers 17 and 18 of the detection system. In other words, the low-pass filter 34 eliminates only the external noise (high-frequency component) without ruining frequency components of original output signals of the pressure transducers 17 and 18. The cut-off frequency $f_{cut}$ is set to be a value within a range between 400 k and 700 kHz although it depends on, for instance, the frequency of a high-frequency noise component generated during the operation of the cigarette manufacturing apparatus.

In case that the low-pass filter 34 has a broad filter characteristic as shown by a characteristic B in FIG. 4, high-frequency components of the outputs of the pressure transducers 17 and 18 are ruined, resulting in a broad (dull) filter output which is similar, for example, to smoothed output signals of the pressure transducers 17 and 18. In order to avert such a problem to thereby retain fully high accuracy of measurement, the low-pass filter 34 having the filter characteristic A is utilized in the embodiment.

The outputs (signals representing air pressures P1, P2 on the inlet and outlet sides) of the first and second pressure transducers 17 and 18 are supplied via the low pass filter 34 to an A/D converter 35 to be converted into digital data, and then fetched via an interface 36 into a CPU that constitutes the data processor 31. The CPU 31 is supplied, via the interface 36, with information on the rotation reference position of the conveyance drum 11, which is detected by the position reference sensor 16. Furthermore, an encoder pulse, representing timing of producing each individual cigarette in the cigarette manufacturing apparatus, is supplied to the CPU 31 from the manufacture controller 50 through a synchronous controller 37 and the interface 36.

The CPU controls which cigarette holder 12 of the conveyance drum 11 holds the filter cigarette C subjected to the ventilation resistance measurement in the measurement section 13 by counting the encoder pulses on the basis of the information on rotation reference position of the conveyance drum 11, and determines timing of the ventilation resistance measurement with respect to the filter cigarette according to the encoder pulses. The timing of the ventilation resistance measurement is determined so as to stabilize flow of the air that is introduced into the filter cigarette C held between the mouthpiece 25 and the first testing ring 21.

The CPU 31 fetches, via the low-pass filter 34, the inlet side and outlet side air pressures P1 and P2 as measured data, which are detected at the aforementioned measurement timing by the first and second pressure transducers 17 and 18, and determines the ventilation resistances of the filter cigarettes C according to the measured data. The CPU shows the measured data, the ventilation resistance, and the like to a manager and an operator through the operation/display section 32, and evaluates the quality of filter cigarettes based on ventilation resistances.

In case that the filter cigarette is judged to have a defective quality based on the information on the ventilation resistance, the CPU 31 gives a command of machine abeyance to the manufacture controller 50 via an output section 38 to thereby discontinue the subsequent manufacture of cigarettes, and gives a command of rejecting the subject filter cigarette out of manufacture lines. The CPU 31 is designed to carry out the just-mentioned measurement processing function when it receives information on start of the cigarette manufacture from the manufacture controller 50 via an input section 39.

Measurement principles of the ventilation resistance in the CPU (data processor) 31 will be explained below.

Figure 5:
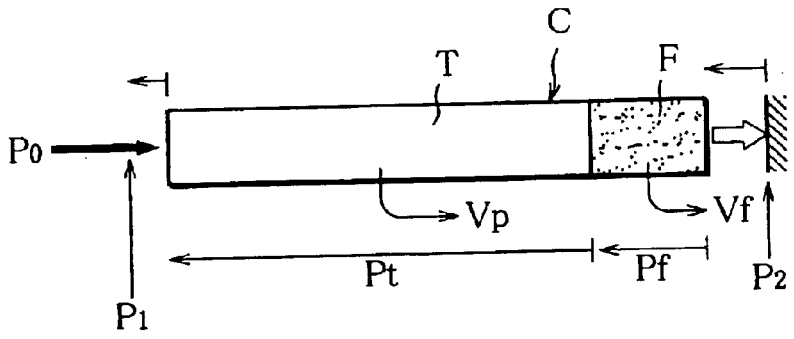
FIG. 5 is a view for explaining measurement principles of ventilation resistance (air leakage ratio) in the cigarette inspection apparatus of FIG. 1.

In the cigarette inspection apparatus, air is introduced to the filter cigarette C from the non-filter side end face thereof at the time of detecting the inlet side and outlet side air pressures P1 and P2. At this moment, part of the air leaks out from the tobacco wrapping section T and filter section F of the cigarette C, as schematically shown in FIG. 5. Amounts of the air leaking out from the tobacco wrapping section T and filter section F correspond to air amounts Vp and Vf flowing into the cigarette through the peripheral surfaces of these sections T and F when the conventional cigarette inspection apparatus shown in FIG. 11 operates to suck out air in the first airtight chamber 2*a* at a fixed flow rate Vc.

In FIG. 5, a sign $P_0$ represents pressure of the air introduced into the cigarette C.

Figure 11:
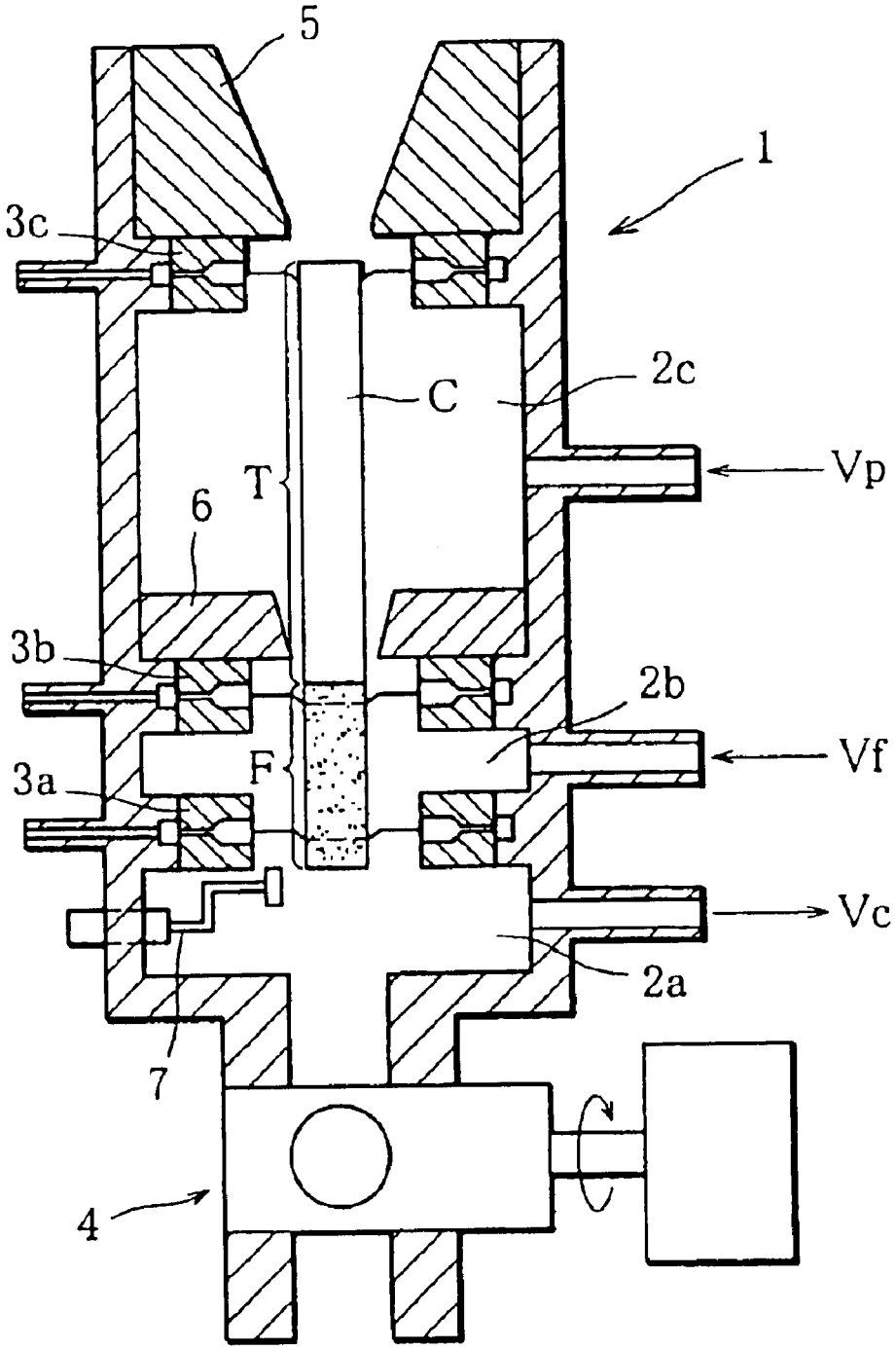
FIG. 11 BACKGROUND ART
FIG. 11 is a view showing a general construction of a conventional cigarette inspection apparatus.

In the conventional cigarette inspection apparatus shown in FIG. 11, air leakage ratio to be determined as ventilation resistance of a cigarette is measured as follows:

$$[\text{leakage ratio}]=(Vp+Vf)/Vc*100(\%)$$

On the other hand, the cigarette inspection apparatus of the present invention performs the measurement of the ventilation resistance with attention to a pressure drop Pt generated in the tobacco wrapping section T and a pressure drop Pf generated in the filter section F that are caused with the air leakage from the cigarette C. In other words, leakage of air from the cigarette C, which has been introduced from the non-filter side tip face of the cigarette C, causes the inlet side air pressure P1 to reduce by pressure drops Pt and Pf, and the resultant air pressure appears at the filter end as the outlet side air pressure P2. That is, the following relation is satisfied.

$$P1=P2+Pt+Pf$$

The apparatus of the present invention is designed to determine to what degree the pressure drop occurs in the inlet side air pressure P1 due to the air leakage, based on a difference between the inlet side air pressure and the outlet side air pressure. Specifically, the air leakage ratio in the cigarette C is found as follows:

$$\begin{aligned}[\text{leakage ratio}] &= [\text{pressure drop}]/[\text{inlet side air pressure}]*100(\%)\\ &= (Pt+Pf)/P1*100(\%)\\ &= (P1-P2)/P1*100(\%)\end{aligned}$$

The resultant is obtained as the ventilation resistance for the purpose of evaluating the quality of a cigarette.

In cases where there is no air leakage at all in the cigarette C, the pressure drops Pt and Pf are not produced, and therefore the outlet side air pressure P2 becomes equal to the inlet side air pressure P1 (P1=P2). In that case, the leakage ratio can be found as follows:

$$\begin{aligned}[\text{leakage ratio}] &= (P1-P2)/P1*100(\%)\\ &= (0)/P1*100(\%)\\ &= 0(\%)\end{aligned}$$

In many cases, however, a filter cigarette is intentionally provided with fine pores for ventilation in the filter section F, and the cigarette generally has the leakage ratio according to a product specification thereof. Comparison of the leakage ratio calculated as mentioned above to a standard leakage ratio determined in accordance with the product specification of the cigarette makes it possible to evaluate with high accuracy the quality associated with the ventilation of the cigarette. For instance, if there is a gap in the wrapping paper due to a defect in adhesion of a seam of the wrapping paper of the tobacco wrapping section T, or if there is a defect, such as scarring, puncture, and the like, in the tobacco wrapping section T or the filter section F, a great air leakage and thus a great pressure drop is generated, and the leakage ratio becomes excessive, resulting in the judgement that there is a quality defect.

Meanwhile, in a filter cigarette, an amount of the air leakage in the tobacco wrapping section T is extremely lower than that in the filter section F in general. Therefore, the standard leakage ratio, which is determined in accordance with the product specification of the cigarette, is determined mainly according to the amount of the air leakage in the filter section F. Consequently, in case that the air leakage ratio is still greater than the standard leakage ratio, it can be anticipated that a main cause is a wrapping defect in the wrapping paper of the tobacco wrapping section T. In other words, the cigarette with the wrapping defect can be positively detected through the quality judgement on the basis of the leakage ratio.

In the cigarette inspection apparatus according to this embodiment, air is introduced from the non-filter side end face of the filter cigarette C into the cigarette that is held between a flat inner end face of the mouthpiece 25 and a flat inner end face of the first testing ring 21, as shown in FIG. 2. Thus, there is fear of generation of the air leakage (leak) in an abutment portion of the mouthpiece 25 and the cigarette C.

In this respect, the cigarette inspection apparatus is designed to measure the outlet side air pressure P2 in a state where an outlet of the air passage on the filter side of the cigarette C is closed as mentioned before, and hence as for the air introduced into the cigarette C, conduction of air in the cigarette C is suppressed. That is, the apparatus does not actively make air conducted in the cigarette as the conventional apparatus shown in FIG. 11 does. The second pressure transducer 18 detects the outlet side air pressure P2 produced on the filter tip of the cigarette C without conducting air. That is to say, as shown in FIG. 6, the second pressure detector 18 substantially detects the pressure drop itself that is caused by the air leakage caused in the tobacco wrapping section T and the filter section F.

An equivalent circuit of the present measurement system shown in FIG. 6 will be briefly explained below.

Figure 6:
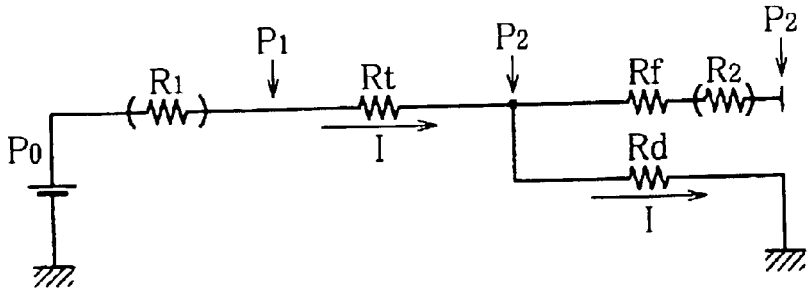
FIG. 6 is a view showing an equivalent circuit of a measurement system for explaining pressure detection by a pressure transducer.

In FIG. 6, resistance Rt, resistance Rf, and resistance Rd represent the ventilation resistance in the tobacco wrapping section T, the ventilation resistance in the filter section F, and overall air leakage resistance in the cigarette C, respectively. Resistance R1 stands for air leakage resistance (leak resistance) on the non-filter side end face of the cigarette C, resistance R2 the air leakage resistance (leak resistance) on the filter side end face of the cigarette C, and I a flow rate of the air introduced into the cigarette C. $P_0$ signifies the pressure of the air introduced into the cigarette C.

The first pressure transducer 17 measures pressure on the basis of atmospheric pressure and detects the sum [(Rt+Rd)·I] of the pressure drop [Rt·I] caused in the cigarette C and the pressure drop [Rd·I] caused due to the air leakage from the cigarette C, as shown in FIG. 6. As for the second pressure transducer 18 for detecting the pressure P2 on the filter side end face of the cigarette C, the flow rate of the air flowing in the cigarette C, especially in the filter side end portion of the cigarette C, is negligible as compared with the flow rate of the air leaking from the cigarette C. Therefore, the pressure reduced due to the air leakage from the cigarette C is transmitted to the filter side end face of the cigarette C. That is, the second pressure transducer 18 detects the pressure drop [Rd·I] itself. In other words, even if there is a leakage (resistance R2) between the filter side end face of a cigarette and the inner end face of the mouthpiece 25, the flow rate of the leak air and thus the pressure drop caused by such leakage is negligible, and accordingly the pressure transducer 18 can detect the pressure drop [Rd·I] caused by the air leakage in the cigarette C without being influenced by the leakage in the filter end.

In this way, according to the present inspection apparatus adapted to measure the air leakage ratio (ventilation resistance) in the cigarette C based on the inlet side and outlet side air pressures P1 and P2 at the time of supplying the pressurized air to the non-filter side end face of the filter cigarette C, the measurement can be performed easily and accurately, compared to a conventional apparatus that measures the flow rate of the air discharged by suction from one airtight chamber and the flow rate of the air flowing into another airtight chamber in a state where each section of the cigarette is kept in a separate airtight chamber. Furthermore, since the mouthpiece 25 and the first testing ring 21, whose respective abutment portions with the cigarette C are made flat, are utilized, it is possible to hold the filter cigarette C between the mouthpiece 25 and the testing ring 21 without difficulty, to thereby connect the inlet side of the cigarette C to a pressure air source and the pressure transducer 17 and also to connect the outlet side thereof to the pressure transducer 18.

Moreover, in the present embodiment, the testing rings 21 and 22 are attached to the existing conveyance drum of the cigarette manufacturing apparatus, and the funnels 24 and 29 are provided in sliding contact with the testing rings 21 and 22. This enables easy connection of a cigarette with the pressure air source and the pressure transducer. As a result, it is possible to inspect all ventilation characteristics of the filter cigarettes manufactured consecutively by the cigarette manufacturing apparatus.

In case of such 100% inspection, the outputs of the first and second pressure transducers 17 and 18 may be extracted at predetermined measurement timing in synchronization with the cigarette conveyance performed by the conveyance drum 11.

Figure 7:
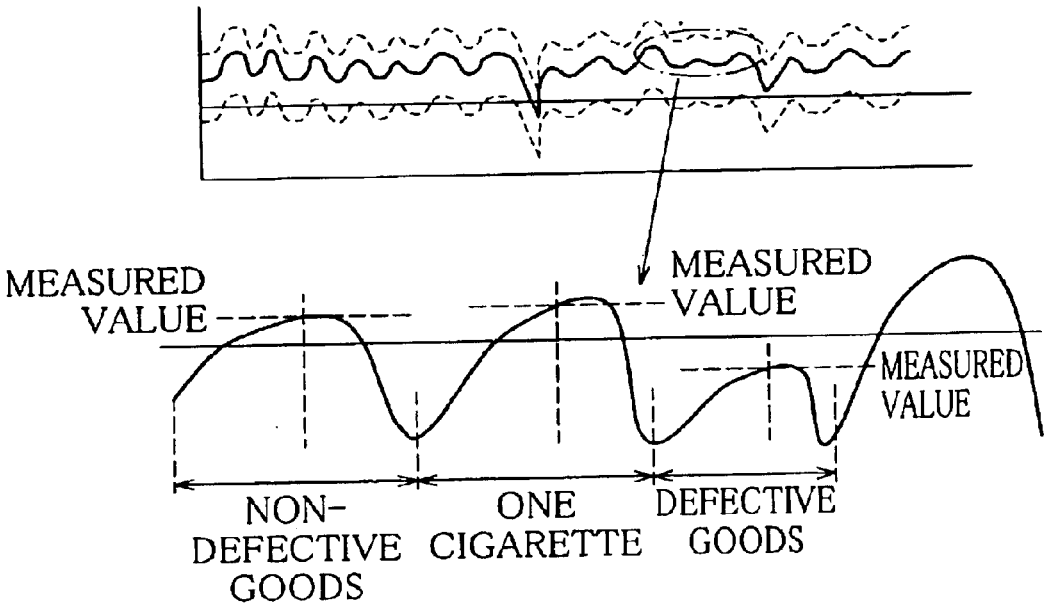
FIG. 7 is a view showing sample timing of measured data in the cigarette inspection apparatus shown in FIG. 1.

As shown in FIG. 7, output voltages of the pressure transducers 17 and 18 indicating the detected pressure fluctuate with elapse of time along with the cigarette conveyance. That is, the air introduction into the cigarette C in the measurement section 13 increases the output voltages of the pressure transducers 17 and 18, whereas the withdrawal of the cigarette C from the measurement section 13 decreases the output voltages of the pressure transducers 17 and 18. While the cigarette C is kept withdrawn from the measurement section 13, the air passage 23 of the testing ring 21 and the insertion through hole 27 of the mouthpiece 25 are open to the atmosphere, which brings the pressure transducers 17 and 18 to measure the atmospheric pressure.

Therefore, in the ventilation resistance measurement, timing of the cigarette conveyance by the conveyance drum 11 is determined on the basis of the encoder pulses supplied from the manufacture controller 50, and a time period of measurement in the measurement section 13 and timing in which the air introduced into the cigarette C is stabilized are set to synchronize with the timing of the cigarette conveyance, and the measured data (outputs of the pressure transducers) is sampled at the set timing. If the air leakage ratio obtained based on the measured data is lower than a predetermined judgement value, the cigarette associated with the measured data is judged defective in quality.

Moreover, according to the above embodiment, the metal mouthpiece 25 having a flat abutment portion with the filter side end is utilized. This causes only a little damage to the filter end of a cigarette, and there hardly is fear of causing damage to the cigarette due to failure in holding the cigarette, unlike the case where a cup-shaped mouthpiece made of synthetic resin is used. Furthermore, a life of the mouthpiece 25 can be made longer to reduce frequency of exchange of the mouthpiece, taking effects of fully heightening the inspection efficiency thereof and so forth.

An evaluation function of the cigarette-holding characteristic of the cigarette inspection apparatus according to the embodiment will be explained below.

The cigarette inspection apparatus is designed to evaluate the cigarette-holding characteristic of each cigarette holder 12 of the conveyance drum 11, based on the measured value (measured data) of the ventilation resistances (air leakage ratios) of a large number of cigarettes. To this end, the CPU 31 of the cigarette inspection apparatus carries out a measurement system control routine shown in FIG. 8.

In order to put this control routine into operation, each of the cigarette holders 12 formed on the peripheral surface of the conveyance drum 11 is assigned a control number beforehand. For instance, in case that forty cigarette holders 12 are provided, the cigarette holders 12 are assigned the control numbers to, respectively.

Figure 8:
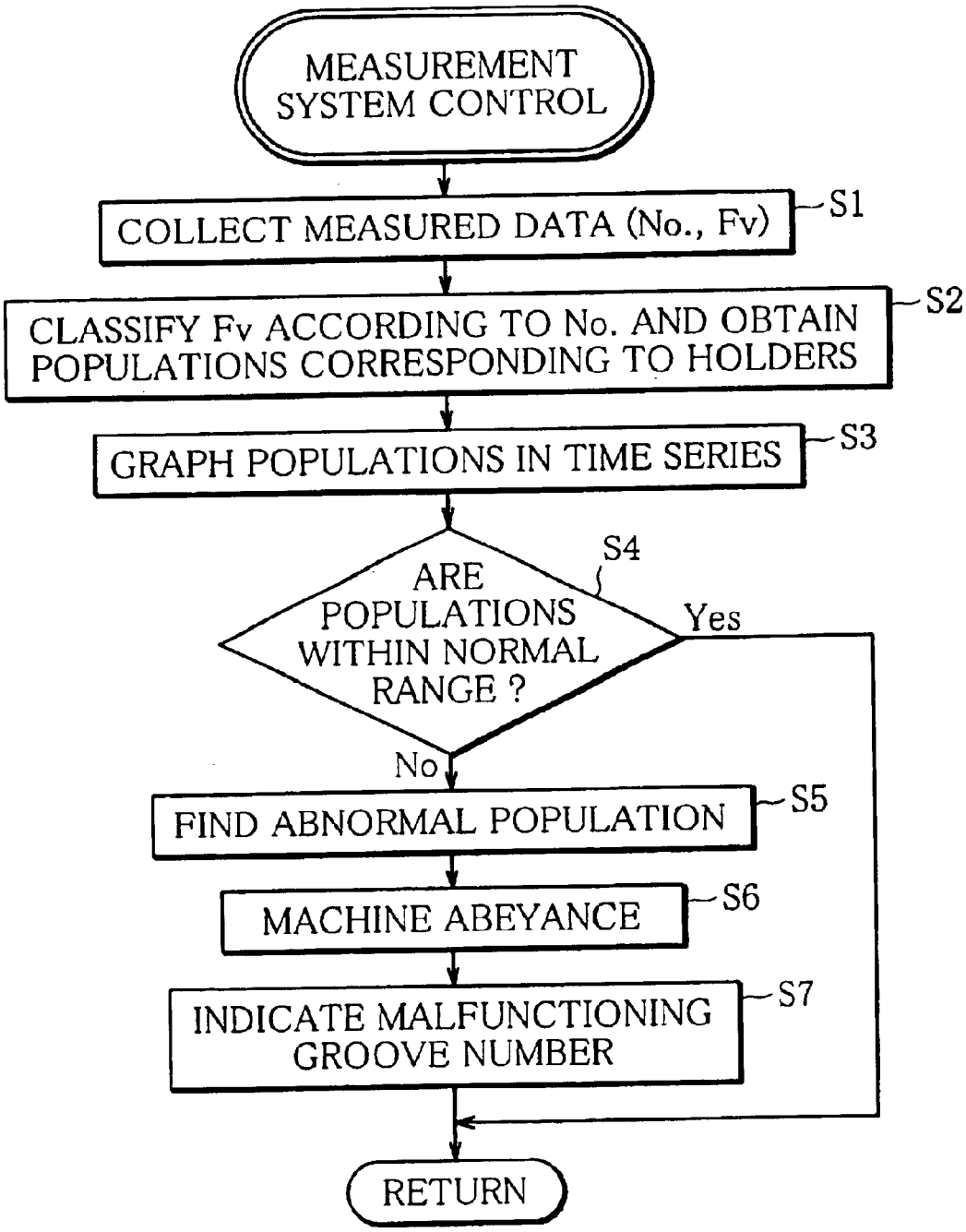
FIG. 8 is a flowchart showing an example of steps in a measured data processing in the cigarette inspection apparatus of FIG. 1.

In the measurement system control routine shown in FIG. 8, the measured data of the ventilation resistances of the filter cigarettes are collected that are measured sequentially in the measurement section 13 during the conveyance drum (inspection drum) 11 rotates [step S1]. In the collection of the measured data, the cigarette holder 12 positioned in the measurement section 13 is identified based on a rotation reference position of the conveyance drum 11 detected by the position reference sensor 16 and the encoder pulses supplied from the manufacture controller 50. Then, the measured data, indicating the ventilation resistance (air leakage ratio) of the filter cigarette C held by this particular cigarette holder 12, is obtained as mentioned before, and the respective measured data are stored in a memory of the data processor 31 so as to correspond to the respective control numbers of the cigarette holders 12. In the step S1, the calculation and storage of such measured data are conducted with respect to one cigarette after another, and the measured data about, for example, 2,000 filter cigarettes are so stored as to correspond to the control numbers [01] to [40].

Next, the measured data about the 2,000 cigarettes are classified so as to be associated with the respective cigarette holders according to the control numbers to, to thereby obtain a population of the measured data related to each of the forty cigarette holders 12.

Figure 9:
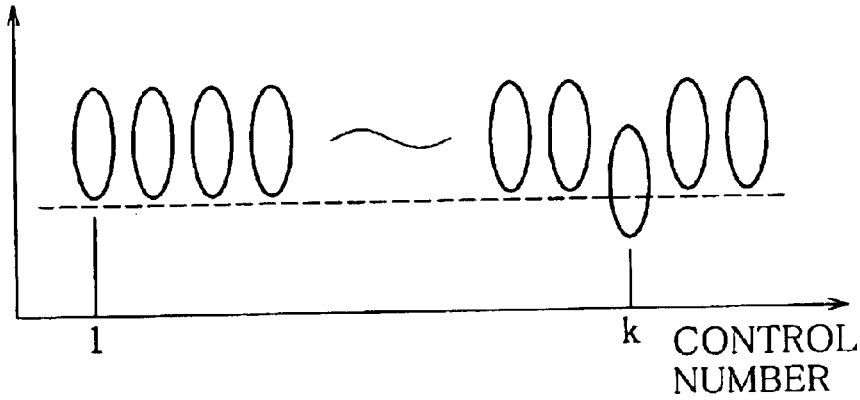
FIG. 9 is a view showing an example of a graphical representation of the measured data.

Thereafter, dispersion (distribution) of a plurality of measured data (herein 50 measured data) is obtained that forms the population of the measured data (measured data constellation) associated with each cigarette holder 12. Then, as exemplified in FIG. 9, a graphical representation of all the measured data distributions in time series is given, in which the respective control numbers of the forty cigarette holders 12 are shown along the horizontal axis, and the measured data distributions related to the respective cigarette holders 12 are shown along the vertical axis. Then, a judgment is made on whether or not the dispersion of the measured data forming each measured data constellation is within a normal range. That is, the judgment is formed on whether or not the measured data distribution is normal. In the judgment, for instance, the measured data distribution is not determined to be normal if at least one of the measured data forming each measured data constellation is out of the normal range.

When the measured data distributions of all the populations are judged normal through the judging process in the step S4, all the cigarette holders 12 hold the filter cigarettes normally, so that it is determined that the cigarette-holding characteristics of all the cigarette holders 12 do not exert a bad influence upon the ventilation characteristic measurement. If it is determined that all the cigarette holders 12 function normally in such a way, the examination of the cigarette-holding characteristics is terminated.

On the contrary, in case that the population is detected in which the measured data distribution is not normal, the cigarette holder 12 corresponding to the subject population is identified [step S5]. Then, a command of machine abeyance is given to the cigarette manufacturing apparatus to suggest maintenance with respect to that cigarette holder 12 [step S6], and the control number identifying the cigarette holder 12 is indicated [step S7].

According to the present apparatus evaluating the quality of the measured data distributions in the measured data constellations (populations) corresponding to the respective cigarette holders 12, and based on the evaluation, judging a degree of influence that each cigarette holder 12 exerts upon the cigarette inspection, it is possible to process the measured data while checking whether or not the cigarette holders 12 normally function, which enables the measurement with high reliability. Moreover, in case that the judgement is formed that any one of the cigarette holders is deteriorated in the cigarette-holding characteristic thereof, the maintenance of the subject cigarette holder can be suggested, thus enabling early elimination of a bad influence that the cigarette holder 12 exerts upon the measurement. In this way, since the ventilation characteristics of cigarettes can be inspected while securing a working condition in which the measurement system including the cigarette holders 12 is stable, the measurement accuracy can be heightened. Furthermore, even if the measured data deviate from the normal value on a large scale due to the deterioration in the cigarette-holding characteristic of the cigarette holder 12, there is no fear of misjudging this to be a quality defect in a cigarette.

Furthermore, the cigarette inspection apparatus according to the present embodiment comprises a function of judging a notable defect in cigarette quality as described below.

The judging function has an aim of making a general quality inspection concerning the ventilation resistances of cigarettes. Specifically, the judging function has been invented with attention to the fact that, if the cigarette has a notable wrapping defect, the inlet side air pressure P1 observed when air is introduced into a cigarette is greatly reduced due to a great air leakage attributable to such a defect. The object of the judging function is to determine cigarettes of low quality without difficulty.

Figure 10:
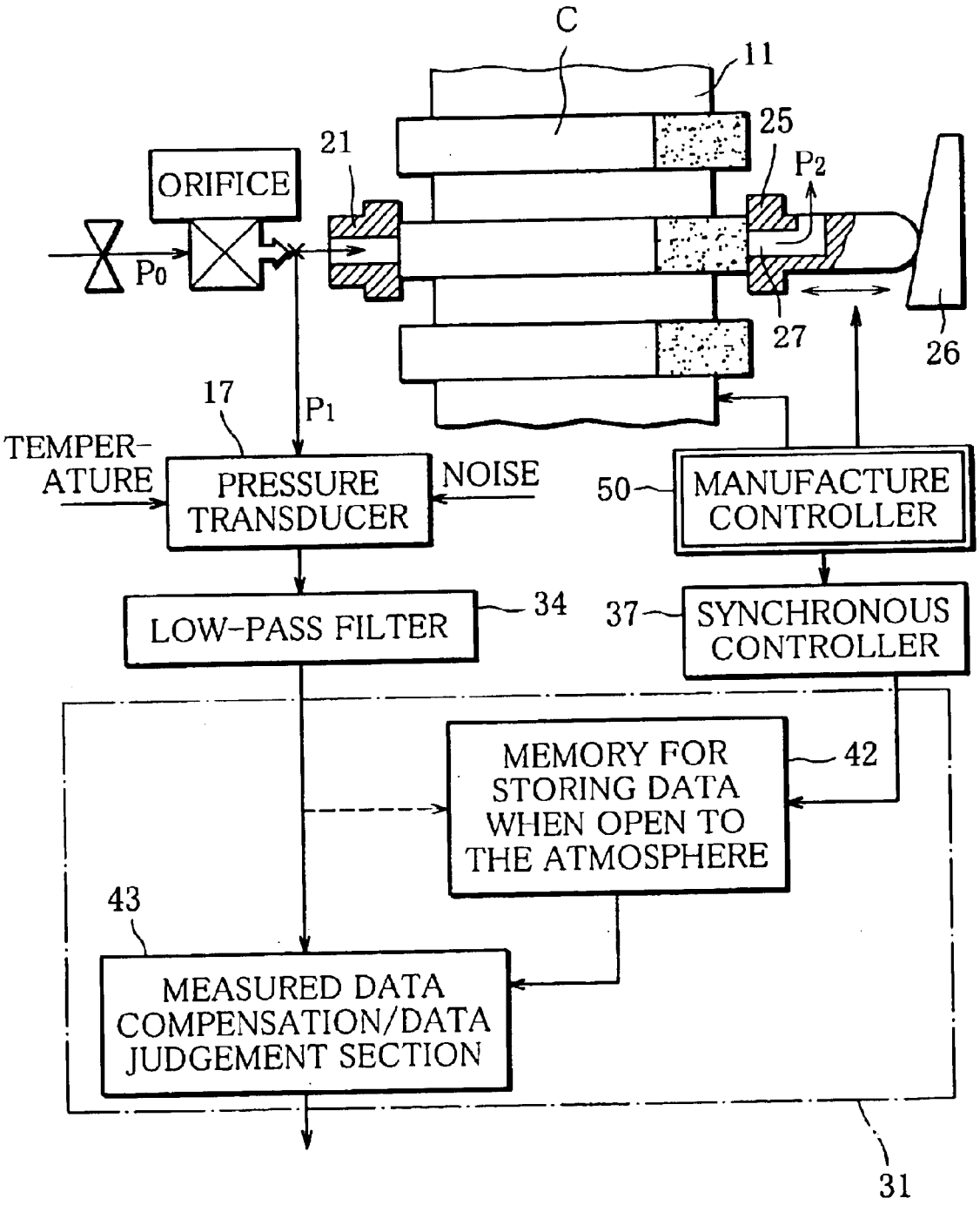
FIG. 10 is a view showing a function of inspecting a cigarette wrapping quality, which function is provided to the cigarette inspection apparatus of FIG. 1.

In connection with such judgement, as shown in FIG. 10, based on output from the synchronous controller 37, the CPU 31 determines a state where the connection of the filter cigarette C and the air source is cut off and the air passage 23 shown in FIG. 2 is open to the atmosphere. At the moment, the CPU 31 fetches an output value (representing the atmospheric pressure) of the first pressure transducer 17 through the low-pass filter 34 to store the output value in a memory 42. Thereafter, the CPU 31 fetches via the low-pass filter 34 the inlet side air pressure P1 detected by the first pressure transducer 17 when air is introduced from the air source to the filter cigarette C through the non-filter side end face thereof, and then compensates the inlet side air pressure value P1 in a measured data compensation/data judgement section 43 by using the atmospheric pressure data value stored in the memory 42. To be specific, the measured data compensation/data judgement section 43 obtains a difference between the inlet side air pressure value P1 and the atmospheric pressure data value, as the compensated inlet side air pressure P1.

A reason for making such compensation is that the pressure drop, generated in the filter cigarette C when the air introduced from the non-filter side end face of the cigarette C leaks into the atmosphere from a wrapping defective part of the cigarette C, corresponds to the difference between the inlet side air pressure P1 and the atmospheric pressure. In other words, the compensated inlet side air pressure P1 indicates such a pressure drop and substantially corresponds to the difference between the inlet side air pressure P1 and the outlet side air pressure P2 shown in FIG. 3.

In the measured data compensation/data judgement section 43, the compensated inlet side air pressure P1 is compared to a reference pressure Pref to thereby determine presence of a wrapping defect in the filter cigarette C. That is to say, when the inlet side air pressure P1 less than the reference pressure Pref is detected, the measured data compensation/data judgement section 43 judges that the cigarette C to be measured has a notable wrapping defect and gives a command of rejection of this cigarette.

According to the cigarette-inspecting function judging the inlet side air pressure P1 of the cigarette C, which is detected by using the first pressure transducer 17, it can be easily judged whether or not there is a great air leakage in a filter cigarette. This makes it possible to easily find the filter cigarette having the wrapping defect which can bring about a great air leakage, based on the inlet side air pressure P1.

The cigarette inspection apparatus according to the present invention is not limited to the above embodiment and can be modified in various ways.

For example, although the apparatus according to the embodiment has a structure in which the conveyance drum as a constituent of the cigarette manufacturing apparatus is utilized as an inspection drum to be incorporated into the cigarette manufacture lines, it is not inevitably necessary to incorporate the inspection apparatus of the present invention into the cigarette manufacture lines. That is, the present invention can be employed in the inspection apparatus in which the ventilation characteristic measurement with respect to the cigarettes, supplied in full from the cigarette manufacture lines or supplied after the sampling, is performed in independent inspection lines that are separated from the cigarette manufacture lines. In this case, for instance, the inspection drum having a structure similar to that of the conveyance drum shown in FIG. 1 and including cigarette holders with openings at one side ends thereof is disposed in the inspection lines, and cigarettes from the cigarette manufacture lines are supplied axially to the cigarette holders from the one end openings thereof at a circumferential position not interfering the measurement section 13.

Although the cigarette inspection apparatus of the embodiment is so constructed as to evaluate the cigarette-holding characteristic, such an evaluating function is not indispensable in the present invention. Furthermore, in case of the inspection apparatus configured to have the function of evaluating the cigarette-holding characteristic, it is not essential to obtain, as characteristic of the population, the dispersion of the measured data forming the measured data constellation (population) corresponding to each cigarette holder 12 as in the embodiment. Alternatively, a mean value of the measured data forming the population may be obtained as characteristic of the population. Also, the number of the measured data forming the population is not particularly limited as long as the number is sufficient to evaluate the cigarette-holding characteristic of each cigarette holder 12.

Moreover, in the present invention, it is not essential to detect the inlet side and outlet side air pressures of a cigarette by using the two pressure transducers as shown in FIGS. 1 to 3. For instance, as explained with reference to FIG. 10, the transducer may be provided only on the inlet side of a cigarette to judge the cigarette quality based only on the inlet side air pressure.

The present invention can be embodied in various modified forms without deviating from the scope of this invention.

What is claimed is:

1. A cigarette inspection apparatus comprising:

air-introducing means for introducing air into a filter cigarette from a first end of the filter cigarette, which is on a non-filter side of the cigarette;

a first pressure transducer for detecting air pressure on a side close to the first end of the filter cigarette; and quality-judging means for judging quality of the filter cigarette, based on the air pressure detected by means of said first pressure transducer;

a second pressure transducer for detecting air pressure produced on a side close to a second end of the filter cigarette, which is a filter side of the cigarette, the air pressure being produced by the air introduced into said filter cigarette, wherein said quality-judging means has measuring means for determining ventilation resistance of the filter cigarette, based on a difference between the air pressures respectively detected by means of said first and second pressure transducers, and judges the quality of the filter cigarette based on said ventilation resistance; and an inspection drum having a peripheral surface thereof formed with cigarette holders for holding filter cigarettes, wherein said air-introducing means sequentially introduces air into the filter cigarettes that are carried one by one to an inspection position according to rotation of said inspection drum, said first and second pressure transducers sequentially detect the air pressures on the sides close to the first and second ends of the filter cigarettes, into each of which air is introduced when the individual cigarette is at the inspection position, said measuring means sequentially determines the ventilation resistances of the filter cigarettes, into each of which air is introduced when the individual cigarette is at the inspection position, and said quality-judging means comprises measured data-classifying means for classifying the ventilation resistances of the filter cigarettes, which have sequentially been determined by means of said measuring means, so that the ventilation resistances of each cigarette correspond to the cigarette holder with which that cigarette has been held, and evaluating means for evaluating a cigarette-holding characteristic of each cigarette holder, based on a characteristic indicated by a set of the ventilation resistances corresponding to that cigarette holder.

2. The cigarette inspection apparatus according to claim 1, wherein said evaluating means determines dispersion or a mean value of the ventilation resistances corresponding to the individual cigarette holder, as the characteristic indicated by the set of the ventilation resistances.

3. The cigarette inspection apparatus according to claim 1, wherein said evaluating means provides a graphical representation of the characteristics, indicated by those sets of the ventilation resistances which correspond to the cigarette holders, in which representation the characteristics are arranged in an order the cigarette holders are guided to the inspection position according to the rotation of said inspection drum.

4. The cigarette inspection apparatus according to claim 1, wherein said evaluating means comprises malfunction-detecting means for detecting the cigarette holder whose cigarette-holding characteristic is deteriorated, based on the characteristics indicated by the sets of the ventilation resistances corresponding to the respective cigarette holders.

* * * * *